US005328887A

United States Patent [19]

Janssens et al.

[11] Patent Number: 5,328,887

[45] Date of Patent: Jul. 12, 1994

[54] THERMALLY TRANSFERABLE FLUORESCENT COMPOUNDS

[75] Inventors: Wilhelmus Janssens, Aarschot; Luc J. Vanmaele, Lochristi, both of Belgium

[73] Assignee: AGFA-Gevaert, N.V., Mortsel, Belgium

[21] Appl. No.: 935,163

[22] Filed: Aug. 26, 1992

[30] Foreign Application Priority Data

Sep. 10, 1991 [EP] European Pat. Off. ..... 91202298.5

[51] Int. Cl.[5] ..... B41M 5/035; B41M 5/38

[52] U.S. Cl. ..... 503/227; 428/195; 428/690; 428/913; 428/914

[58] Field of Search ..... 8/471; 428/195, 690, 428/913, 914; 503/227

[56] References Cited

U.S. PATENT DOCUMENTS 4,627,997 12/1986 Ide ..... 428/216

FOREIGN PATENT DOCUMENTS 1301657 1/1973 United Kingdom ..... 428/913

*Primary Examiner*—B. Hamilton Hess

*Attorney, Agent, or Firm*—Breiner & Breiner

[57] ABSTRACT

A donor element for use in a thermal transfer process comprising a support having on one side thereof a thermally transferable fluorescent heterocyclic compound dispersed in a polymeric binder, characterized in that said fluorescent compound corresponds to one of the following general formulae (A) and (B):

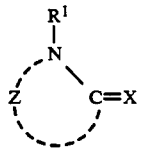

(A)

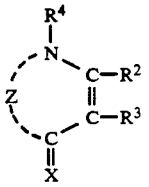

(B)

wherein:

$R^1$ represents a hydrocarbon group or a substituted hydrocarbon group;

$R^2$ represents hydrogen, a hydrocarbon group, a substituted hydrocarbon group, a carboxylic acid group, an ester group, a nitro group, a carbamoyl group, a substituted carbamoyl group, an amino group or a substituted amino group;

$R^3$ represents hydrogen, a hydrocarbon group or a substituted hydrocarbon group, a carboxylic acid group, an ester group, a carbamoyl group or a substituted carbamoyl group;

$R^4$ represents hydrogen or a hydrocarbon group or a substituted hydrocarbon group;

X represents an electronegative substituent with respect to the carbon atom to which it is attached; and Z represents the atoms necessary to close a quinoline nucleus or such a nucleus in substituted form.

10 Claims, No Drawings

THERMALLY TRANSFERABLE FLUORESCENT COMPOUNDS

DESCRIPTION

1. Field of the invention

The present invention relates to fluorescent donor elements for use in a thermal transfer process.

2. Background of the invention

In recent years, thermal transfer systems have been developed to obtain prints from pictures which have been generated electronically from a colour video camera. According to one way of obtaining such prints, an electronic picture is first subjected to colour separation by colour filters. The respective colour-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other-two colours. A colour hard copy is thus obtained which corresponds to the original picture viewed on a screen. Further details of this process and an apparatus for carrying it out are contained in U.S. Pat. No. 4,621,271.

The system described above has been used to obtain visible dye images. However, for security purposes, to inhibit forgeries or duplication, or to encode confidential information, it would be advantageous to create non-visual ultraviolet absorbing images that fluoresce with visible emission when illuminated with ultraviolet light.

U.S. Pat. No. 4,627,997 discloses a fluorescent thermal transfer recording medium comprising a thermally-meltable, wax ink layer. In that system, the fluorescent material is transferred along with the wax material when it is melted. Wax transfer systems, however, are incapable of providing a continuous tone. Further, the fluorescent materials of that reference are incapable of diffusing by themselves in the absence of the wax matrix.

U.S. Pat. No. 4,891,352 discloses fluorescent 7-aminocarbostyril compounds which are useful indeed in a continuous tone thermal transfer process and which have sufficient vapor pressure to transfer or diffuse by themselves from a donor element to a receiving element. However, the use of these known compounds is limited by their poor solubility in environmentally fully accepted organic solvents.

SUMMARY OF THE INVENTION

It is an object of the present invention to provide a new class of fluorescent compounds for use in a thermal transfer process.

It is a further object of the present invention to provide fluorescent compounds having a good solubility in organic solvents which are generally considered as harmless to the environment.

In accordance with the present invention these objects can be obtained by a donor element for use in a thermal transfer process comprising a support having on one side thereof a thermally transferable fluorescent heterocyclic compound dispersed in a polymeric binder, characterized in that said fluorescent compound corresponds to one of the following general formulae (A) and (B):

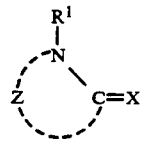

(A)

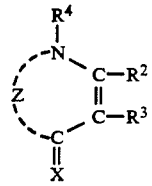

(B)

wherein:

$R^1$ represents a hydrocarbon group or a substituted hydrocarbon group;

$R^2$ represents hydrogen, a hydrocarbon group, a substituted hydrocarbon group, a carboxylic acid group, an ester group, a nitro group, a carbamoyl group, a substituted carbamoyl group, an amino group or a substituted amino group;

$R^3$ represents hydrogen, a hydrocarbon group or a substituted hydrocarbon group, a carboxylic acid group, an ester group, a carbamoyl group or a substituted carbamoyl group;

$R^4$ represents hydrogen or a hydrocarbon group or a substituted hydrocarbon group;

X represents an electronegative substituent with respect to the carbon atom to which it is attached; and Z represents the atoms necessary to close a quinoline nucleus or such a nucleus in substituted form.

The present invention also includes the use of tautomeric structures of fluorescent compounds having formula (B) wherein $R^4$ represents hydrogen.

DETAILED DESCRIPTION OF THE INVENTION

Fluorescent compounds within the scope of said formulae (A) and (B) and that are suitable for use according to the present invention are compounds of the quinolin-2-one and quinolin-4-one series respectively and compounds structurally derived therefrom wherein the oxygen atom of the 2-one and 4-one group is substituted by a sulphur atom, a dicyano-methylene group, an imino group including an imino group substituted with a carbocyclic or heterocyclic radical of aromatic nature, an oxime group, a hydrazone group or a substituted hydrazone group.

The group X preferably represents oxygen, sulphur, an imino group including an imino group substituted with a carbocyclic or heterocyclic group of aromatic character, a $C(CN)_2$ group, an oxime substituted with an aliphatic group, e.g. an alkyl group, a hydrazone group, a substituted hydrazone group particularly a N—NR″R‴ group or a group introduced by means of an active methylene compound and wherein the carbon atom of the active methylene compound is double bonded to the carbon atom linked to X, and R″ and R‴ each represents hydrogen, an alkyl group, a substituted alkyl group, an aralkyl group, a substituted aralkyl group, a cycloalkyl group, a substituted cycloalkyl group, an aryl group, a substituted aryl group, an acyl group, a carboxylic acid acyl, a sulphonic acid acyl group either or not in substituted form, a carbamoyl group($CONH_2$) or a substituted carbamoyl group.

X may represent for example the group CQQ' wherein each of Q and Q' represents an electronegative substituent, e.g. comprised in the group of a cyano group, an aryl group, an acyl group, a carboxylic ester group, or an amide group or said groups carrying substituents which substituents maintain or enhance the electronegativity of the whole Q or Q' substituent.

Examples of $R^2$ include an alkyl group or a substituted alkyl group e.g. a $C_1$–$C_{15}$ alkyl group; an aralkyl group; a substituted aralkyl group; a cycloalkyl group; a substituted cycloalkyl group and a carbonylalkoxy group for example a carbethoxy group.

Examples of $R^3$ include an alkyl group or a substituted alkyl group e.g. a $C_1$–$C_{15}$ alkyl group; an aralkyl group; a substituted aralkyl group; a cycloalkyl group; a substituted cycloalkyl group and a carbonylalkoxy group for example a carbethoxy group.

Examples of substituents for the ring closed by Z are alkyl, e.g. methyl, substituted alkyl e.g. trifluoromethyl; halogen e.g. chlorine and fluorine; an imino group; a substituted amino group e.g. a dialkylamino group; a hydroxyl group; an alkoxy group, e.g. a methoxy group; a carbamoyl group; a substituted carbamoyl group e.g. a $CONHCH_3$ group; an aminoacyl group, e.g. a $NHCOC6H_5$ group; a sulfamoyl group; a N-substituted sulfamoyl group e.g. a $SO_2N(CH_3)_2$ group; a sulfonylfluoride group or a carbonylalkoxy group e.g. a carbethoxy group.

Further representatives of the fluorescent compounds used according to the present invention are represented by the general formulae:

(C)

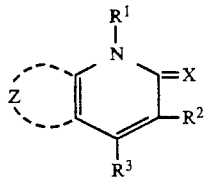

(D)

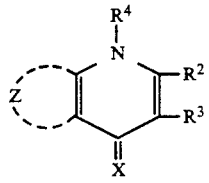

wherein $R^1$ $R^2$ $R^3$ $R^4$ Z and X have the meanings set forth hereinbefore. Fluorescent compounds according to the general formulae set forth hereinbefore are described in GB-A-1 301 657 and are exemplified in Tables I, II and III thereof. In Table III thereof so-called "duplo" structures, i.e. a structure wherein two quinol-2-one or two quinol-4-one rings are chemically linked e.g. by a chemical bond or a group $X_1$ are set forth.

GB-A-1 301 657 also contains a detailed description of various methods of preparing the compounds involved. For more information on specific compounds as well as on the preparation thereof reference can be made to said GB-A-1 301 657.

The fluorescent compound according to the present invention is used in the donor element at a coverage of from about 0.01 to about 0.5 $g/m^2$.

A visible dye can also be used in a separate area of the donor element of the invention provided it is transferable to the dye-receiving layer by the action of heat. Especially good results have been obtained with sublimable dyes. Examples of sublimable dyes include anthraquinone dyes, azo dyes, direct dyes, acid dyes, basic dyes and dyes which are disclosed in EP 432829, EP 432314, EP 400706 and in the European patent applications Nos 90203014.7 and 91200791.1. Said dyes may be employed singly or in combination to obtain a monochrome. The dyes may be used at a coverage of from about 0.05 to about I $g/m^2$ and are preferably hydrophobic.

The fluorescent compound in the donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile); a poly(sulfone) or a poly(phenylene oxide). The binder may be used at a coverage of from about 0.1 to about 5 $g/m^2$.

The fluorescent compound layer of the donor element may be coated on the support or printed thereon by a printing technique such as a gravure process.

Any material can be used as the support for the donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

The reverse side of the donor element is coated with a slipping layer to prevent the printing head from sticking to the donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711, 4,737,485, 4,738,950, and 4,717,712. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally-in the range of about 0.001 to about 2 $g/m^2$. If a polymeric binder is employed, the lubricating material is present in the range of 0.1 to 50weight %, preferably 0.5 to 40, of the polymeric binder employed.

The receiving element that is used with the donor element of the invention usually comprises a support having thereon an image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the receiving element may also be reflective such as baryta-coated paper, polyethylene-coated paper, white polyester (polyester with white pigment incorporated therein), an ivory paper, a condenser paper or a synthetic paper such as dupont Tyvek.

The image-receiving layer may comprise, for example, a polycarbonate, a polyurethane, a polyester, polyvinyl chloride, poly(styrene-co-acrylonitrile), poly(caprolactone) or mixtures thereof. The image-receiving layer may be present in any amount which is effective for the intended purpose. In general, good results have been obtained at a concentration of from about 1 to about 5 $g/m^2$.

As noted above, the donor elements of the invention are used to form a transfer image. Such a process comprises imagewise-heating a donor element as described above and transferring a fluorescent compound image to a receiving element to form the transfer image.

The donor element of the invention may be used in sheet form or in a continuous roll or ribbon. If a continuous roll or ribbon is employed, it may have only the fluorescent compound thereon as described above or may have alternating areas of different dyes, such as sublimable magenta and/or yellow and/or cyan and/or black or other dyes. Thus, one-, two-, three- of four-colour elements (or higher numbers also) are included within the scope of the invention.

In a preferred embodiment of the invention, the donor element comprises a poly(ethylene terephthalate) support coated with sequential repeating areas of magenta, yellow, and cyan dye and the fluorescent material as described above, and the above process steps are sequentially performed for each colour to obtain a three-colour dye transfer image containing a fluorescent image.

Thermal printing heads which can be used to transfer fluorescent compound and dye from the donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal transfer assemblage of the invention comprises (a) a donor element as described above, and (b) a receiving element as described above, the receiving element being in a superposed relationship with the donor element so that the fluorescent material layer of the donor element is in contact with the image receiving layer of the receiving element.

The following example is provided to illustrate the invention.

EXAMPLE

A donor element for use in a thermal transfer process was prepared as follows.

To avoid sticking of the donor element to the thermal printing head the rear side of a 5 μm polyethylene terephthalate support was provided first with a solution for forming a slipping layer, said solution comprising 10 g of co(styrene/acrylonitrile) comprising 104 styrene units and 53 acrylonitrile units, which copolymer is sold under the trade mark LURAN 378 P by BASF AG, D-6700 Ludwigshafen, West Germany, 10 g of a 1% solution of polysiloxane polyether copolymer sold under the trade mark TEGOGLIDE 410 by Th. Goldschmidt AG, D-4300 Essen 1, Goldschmidtstrasse 100, West Germany, and sufficient ethyl methyl ketone solvent to adjust the weight of the solution to a total of 100 g. From this solution a layer having a wet thickness of 15 μm was printed by means of a gravure press. The resulting layer was dried by evaporation of the solvent.

An amount of a fluorescent compound as identified in the Table hereinafter, and a binder resin in an amount, both as defined in the same Table, were dissolved in 10 ml of a solvent, as defined in the same Table. The resulting ink-like composition was coated by means of a doctor knife on the front side of the polyethylene terephthalate support at a wet layer thickness of 100 μm and dried.

The fluorescent compounds tested have the following chemical formulae:

Compound no. 1
(the tautomer of compound no. 9 in Table I of GB 1301657)

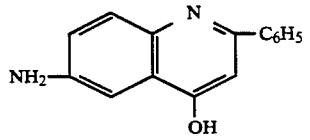

Compound no. 2

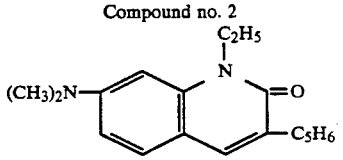

Compound no. 3

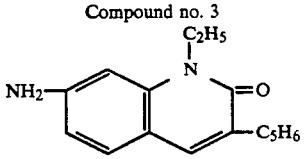

A commercially available Hitachi material (VY-S100A-papier ink set) was used as receiver sheet.

The donor element was printed in combination with the receiver sheet in a Hitachi colour video printer VY-100A.

The receiver sheet was separated from the dye-donor element and the relative emission was visually evaluated using a fixed intensity 366 nm excitation beam (CAMAG UV-Cabinet II).

TABLE

| Fluorescent compound no. | Binder | mg dye/ mg binder | Solvent | Visual colour |
|---|---|---|---|---|
| 1 | CAB | 50/50 | THF | yellowish-green |
| 1 | CN | 50/20 | THF | yellowish-green |
| 2 | CAB | 50/50 | EMK | yellowish-white |
| 2 | CN | 50/20 | EMK | yellowish-white |
| 3 | CAB | 50/50 | EMK | yellowish-green |
| 3 | CN | 50/20 | EMK | yellowish-green |

THF stands for tetrahydrofurane
EMK stands for ethyl methyl ketone
CAB stands for cellulose acetate butyrate having an acetyl content of 29.5% and a butyryl content of 17% (Tg 161° C.; melting range: 230°-240° C.)
CN stands for cellulose nitrate.

We claim:

1. A donor element for use in a thermal transfer process comprising a support having a thickness of from about 2 to 30 μm and having on one side thereof a thermally transferable fluorescent heterocyclic compound dispersed in a polymeric binder, said fluorescent compound corresponding to one of the following general formulae (A) and (B):

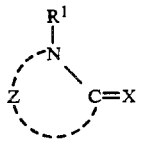

(A)

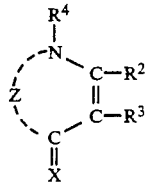

(B)

wherein:

$R^1$ represents a hydrocarbon group or a substituted hydrocarbon group;

$R^2$ represents hydrogen, a hydrocarbon group, a substituted hydrocarbon group, a carboxylic acid group, an ester group, a nitro group, a carbamoyl group, a substituted carbamoyl group, an amino group or a substituted amino group;

$R^3$ represents hydrogen, a hydrocarbon group or a substituted hydrocarbon group, a carboxylic acid group, an ester group, a carbamoyl group or a substituted carbamoyl group;

$R^4$ represents hydrogen or a hydrocarbon group or a substituted hydrocarbon group;

X represents an electronegative substituent with respect to the carbon atom to which it is attached; and Z represents the atoms necessary to close a quinoline nucleus or such a nucleus in substituted form.

2. A donor element according to claim 1, wherein X represents oxygen, sulphur, an imino group or an imino group substituted with a carbocyclic or heterocyclic group of aromatic character, an oxime group, an oxime group substituted with an aliphatic group, a hydrazone group, a substituted hydrazone group or a group introduced by means of an active methylene compound and wherein the carbon atom of the active methylene compound is double bonded to the carbon atom linked to X.

3. A donor element according to claim 1, wherein X represents the group CQQ' wherein each of Q and Q' represents an electronegative substituent.

4. A donor element according to claim 3, wherein the electronegative substituent is a member selected from the group consisting of a cyano group, an aryl group, an acyl group, a carboxylic ester group, an amide group or said groups carrying substituents capable of maintaining or enhancing the electronegativity of the whole Q or Q' substituent.

5. A donor element according to claim 1 wherein said fluorescent compound corresponds to one of the following general formulae (C) and (D)

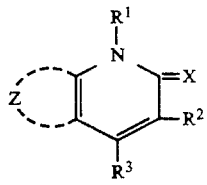

(C)

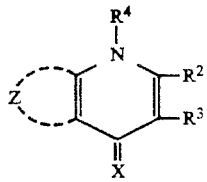

(D)

wherein $R^1$, $R^2$, $R^3$, $R^4$, Z and X have the meanings given to them in claim 1.

6. A donor element according to claim 5, wherein X represents oxygen, $R^1$ represents an alkyl group, $R^2$ represents an aryl group, $R^3$ represents hydrogen, $R^4$ represents an alkyl group or a hydrogen atom, and Z represents the necessary atoms to close a quinoline nucleus substituted by an amino group or a dialkylamino group.

7. A donor element according to claim 1, wherein said donor element comprises sequential repeating areas of magenta, yellow and cyan dye, and said fluorescent compound.

8. A donor element according to claim 1, wherein the other side of the support is provided with a slipping layer comprising a lubricant.

9. A thermal transfer assemblage comprising:

(a) a donor element comprising a support having on one side thereof a thermally transferable heterocyclic compound dispersed in a polymeric binder, and (b) a receiving element comprising a support having thereon an image-receiving layer, said receiving element being in a superposed relationship with said donor element so that said one side of the donor element is in contact with said image-receiving layer, said donor element comprising a support having on one side thereof a thermally transferable fluorescent heterocyclic compound dispersed in a polymeric binder, said fluorescent compound corresponding to one of the following general formulae (A) and (B):

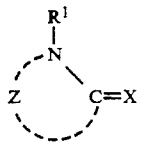

(A)

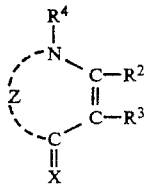

(B)

wherein:

$R^1$ represents a hydrocarbon group or a substituted hydrocarbon group;

$R^2$ represents hydrogen, a hydrocarbon group, a substituted hydrocarbon group, a carboxylic acid group, an ester group, a nitro group, a carbamoyl group, a substituted carbamoyl group, an amino group or a substituted amino group;

$R^3$ represents hydrogen, a hydrocarbon group or a substituted hydrocarbon group, a carboxylic acid group, an ester group, a carbamoyl group or a substituted carbamoyl group;

$R^4$ represents hydrogen or a hydrocarbon group or a substituted hydrocarbon group;

X represents an electronegative substituent with respect to the carbon atom to which it is attached; and Z represents the atoms necessary to close a quinoline nucleus or such a nucleus in substituted form.

10. A process of forming a thermal transfer image comprising image-wise heating a donor element, and transferring an image to a receiving element comprising a support and an image-receiving layer to form said thermal transfer image, wherein said donor element comprises a support having on one side thereof a thermally transferable fluorescent heterocyclic compound dispersed in a polymeric binder, said fluorescent compound corresponding to one of the following general formulae (A) and (B):

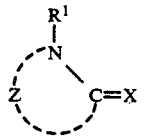

(A)

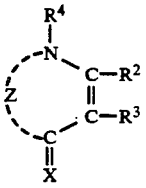

(B)

wherein:

$R^1$ represents a hydrocarbon group or a substituted hydrocarbon group;

$R^2$ represents hydrogen, a hydrocarbon group, a substituted hydrocarbon group, a carboxylic acid group, an ester group, a nitro group, a carbamoyl group, a substituted carbamoyl group, an amino group or a substituted amino group;

$R^3$ represents hydrogen, a hydrocarbon group or a substituted hydrocarbon group, a carboxylic acid group, an ester group, a carbamoyl group or a substituted carbamoyl group;

$R^4$ represents hydrogen or a hydrocarbon group or a substituted hydrocarbon group;

X represents an electronegative substituent with respect to the carbon atom to which it is attached; and Z represents the atoms necessary to close a quinoline nucleus or such a nucleus in substituted form.

* * * * *